US007665341B2

(12) United States Patent
Kinoshita

(10) Patent No.: US 7,665,341 B2
(45) Date of Patent: Feb. 23, 2010

(54) NEGATIVE-ANGLE PRESS-WORKING DIE

(75) Inventor: Tadatoshi Kinoshita, Tokyo (JP)

(73) Assignee: Yourbusiness Co., Ltd., Tokyo (JP)

( * ) Notice: Subject to any disclaimer, the term of this patent is extended or adjusted under 35 U.S.C. 154(b) by 1 day.

(21) Appl. No.: 12/213,335

(22) Filed: Jun. 18, 2008

(65) Prior Publication Data

US 2009/0113978 A1 May 7, 2009

(30) Foreign Application Priority Data

Nov. 6, 2007 (JP) ..... 2007-288585

(51) Int. Cl.
*B21D 5/02* (2006.01)
*B21D 11/00* (2006.01)
*B21J 9/18* (2006.01)

(52) U.S. Cl. ..... 72/381; 72/315; 72/452.9

(58) Field of Classification Search ..... 72/312–315, 72/319–323, 381, 384, 387, 403, 452.1, 452.2, 72/452.4, 452.8, 452.9
See application file for complete search history.

(56) References Cited

U.S. PATENT DOCUMENTS 6,196,040 B1 * 3/2001 Matsuoka ..... 72/315
7,243,524 B2 * 7/2007 Kinoshita ..... 72/381
2008/0098792 A1 * 5/2008 Nieschulz ..... 72/452.4

FOREIGN PATENT DOCUMENTS

JP 59-197318 11/1984

* cited by examiner

*Primary Examiner*—Dana Ross
*Assistant Examiner*—Teresa M Bonk
(74) *Attorney, Agent, or Firm*—Wenderoth, Lind & Ponack, L.L.P.

(57) ABSTRACT

To enable formation at a negative angle with deep bending and forming a high-quality panel, a negative-angle press-working die includes an elevatable pad fixed to an upper die, a slide cam supported to be slidable laterally on the upper die or a lower die and having a bending blade, a rotary cam rotatable about a rotational center having a bending part which forms a negative-angle portion on a workpiece and a cam surface abutting on the slide cam, an elevatable slide body disposed under the pad so as to be rotatable together with the rotary cam and having a hold part provided at an upper portion on a bending part side of the rotary cam and constituting a part of a male die for workpiece forming, a drive unit that rotates the rotary cam to a workpiece working position, and a slide drive unit that slides the slide body in an up and down direction.

2 Claims, 9 Drawing Sheets

NEGATIVE-ANGLE PRESS-WORKING DIE

BACKGROUND OF THE INVENTION

1. Field of the Invention

The present invention relates to a negative-angle press-working die, which performs bending or the like of an automobile panel with negative angle working.

2. Prior Art

Negative angle working to be performed on a front pillar, roof and rear window of a body side outer panel of an automobile panel is difficult as the front pillar, roof and rear window have complicated cross-sectional shapes. Because the cross-sectional shape of a portion from the front pillar to the roof needs to keep the strength with a small cross section, negative angle forming of this part is particularly difficult. As a press-working die to overcome such difficulty, a press-working die disclosed in, for example, JP-A-59-197318 is known. As shown in FIG. 8A, the press-working die is of a columnar cam type that includes a lower die having a hold part 16*b* for holding a raw material on the upper portion of a fixed punch 16*a* of the lower die, and a cam groove having an arc surface continual to the hold part 16*b*, a columnar rotary cam 17 which is provided at the lower die 14 to be rotatably inserted in the cam groove and has a bending part 17*a* at its one end, an elevatable and laterally slidable aerial cam which is provided above the rotary cam 17, has a bending blade at a distal end, and rotates the rotary cam 17 in a direction of holding the raw material, and a pad elevatably disposed above the hold part 16*b* of the lower die. The press-working die performs complicated bending of the pillar (workpiece 12) with the rotary cam 17.

Recently, the demanded cross-sectional shape of a workpiece is getting complicated, for example, from the one shown in FIG. 8A to the one shown in FIG. 8B, so that even the use of the conventional negative-angle press-working die makes it difficult to achieve negative angle forming. That is, as shown in FIG. 8B, the shape is thin and has deep bending, so that the width where the fixed punch 16*a* or hold part is present cannot be set, and with a clearance 18 for panel removal provided, the space becomes larger, so that the raw material panel cannot be pressed with the pad of the upper die. This leads to reduction in the quality of the formed panel. If the bending of the curved shape of a workpiece is deep and the level difference in the up and down direction is large, the separation line between the fixing punch and the rotary cam has different heights at individual cross sections, and designing the panel with a single cross section is not possible. It is therefore necessary to separate the press-working steps, or separate a die 20 of the columnar cam type into a front pillar A, roofs B, C, a rear D, and so forth, as shown in FIG. 9, which need to be arranged along the inclinations of the respective workpiece and need to be formed in multiple steps.

SUMMARY OF THE INVENTION

Accordingly, it is an object of the present invention to provide a negative-angle press-working die which overcomes the conventional problem and can form a negative angle with deep bending and can form a high-quality panel.

To achieve the object, according to the invention, there is provided a negative-angle press-working die including an elevatable pad fixed to an upper die; a slide cam supported on the upper die or a lower die, having a bending blade formed at one end portion, having cam surfaces on both upper and lower sides, and supported so as to laterally slide along both of the cam surfaces; a rotary cam having, at one end thereof, a bending part which forms a negative-angle portion on a workpiece, having a cam surface abutting on one of the cam surfaces of the slide cam, and being rotatable about a rotational center; a slide body disposed under the pad, having a hold part provided at an upper portion on a bending part side of the rotary cam and constituting a part of a male die for workpiece forming, being elevatably held, and rotatable together with the rotary cam; a drive unit that rotates the rotary cam at a workpiece working position; and a slide drive unit that slides the slide body in an up and down direction.

It is preferable that the drive unit should be disposed under the rotary cam, and have a horizontally movable slide block provided at a drive-axial distal end of an air cylinder and having a tapered portion at an upper surface on a distal end side, and the rotary cam should be rotated as the tapered portion abuts on a lower portion of the rotary cam to push up the lower portion.

The slide drive unit preferably includes a cam slide having, on an upper side, a cam surface on which the slide body is slidable, and having a lower end supported at an end portion of the rotary cam so as to be movable laterally, an urging section that urges the cam slide in a direction away from the rotational center of the rotary cam, and an upper die driver having, at a lower end portion of a side face thereof, a cam surface which abuts on an upper end portion of a side face of the cam slide to forcibly move the cam slide laterally, and fixed to the upper die.

The negative-angle press-working die according to the present invention not only can form a negative angle with deep bending, which cannot be achieved by a columnar cam type using the rotary cam of the prior art, but also need not form a panel removing clearance needed by the prior art to remove a panel, thereby improving the quality of the panel dramatically.

Further, it becomes possible to keep separation of a die to a minimum, thereby enabling reduction of the working costs. Furthermore, it becomes possible to set the axis of the rotational center horizontal without inclination of the axis, thereby contributing to the reduction of production costs of the dies.

BRIEF DESCRIPTION OF THE DRAWINGS

8B is a cross-sectional view of essential portions showing a state where a workpiece is bent deeper in the press-working die.

DETAILED DESCRIPTION OF THE PREFERRED EMBODIMENTS

Figure 1:
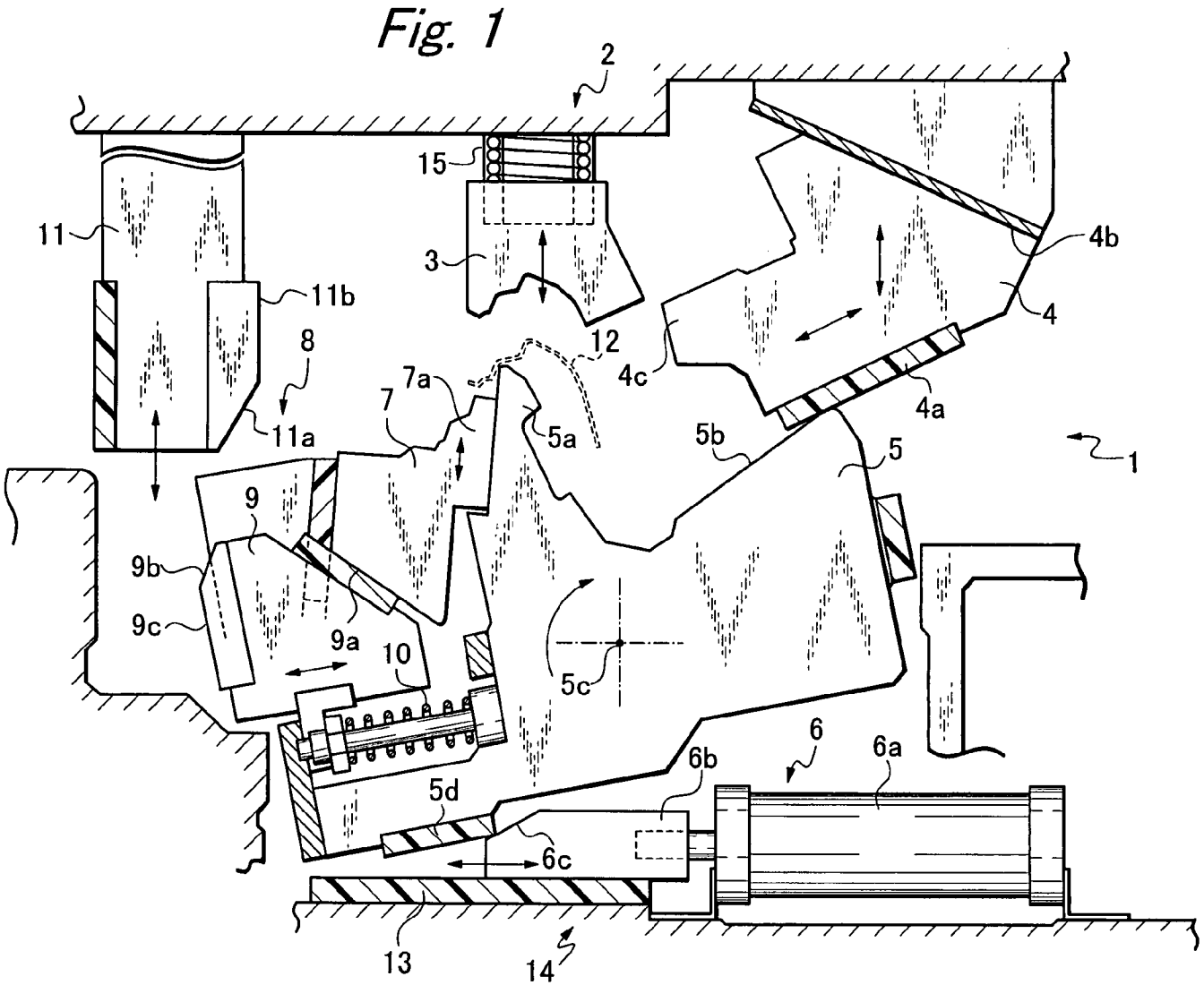
FIG. 1 is a longitudinal cross-sectional view showing the schematic structure of a negative-angle press-working die according to an embodiment of the present invention.

FIG. 1 shows a negative-angle press-working die 1 according to an embodiment of the present invention, which forms an automobile panel or the like into a complicated cross-sectional shape. The negative-angle press-working die 1 includes an elevatable pad 3 fixed to an upper die 2, a laterally slidable aerial cam 4 serving as a slide cam, a rotary cam 5 which rotates about a rotational center 5*c*, a drive unit 6 for rotating the rotary cam 5, a slidable slide body 7 having a workpiece hold part 7*a*, and a slide drive unit 8 that slides the slide body 7. The aerial cam 4 serving as a slide cam is not limited to this aerial type, and may be slidably supported at a lower die.

The aerial cam 4 is suspended from the upper die 2 via a cam surface 4*b*, and has a cam surface 4*a* on a bottom surface side, and a bending blade 4*c* formed at its distal end portion. The aerial cam 4 is supported at the upper die 2 so as to laterally slide along the cam surfaces 4*a*, 4*b* as the upper die 2 is elevated up and down.

The rotary cam 5 is disposed to be rotatable about the rotational center 5*c*, has, on the top surface side, a bending part 5*a* for forming a negative angle portion in a workpiece to be subjected to bending and a cam surface 5*b* corresponding to the cam surface 4*a* of the aerial cam 4, and has, on one end side of the bottom surface, a slide plate 5*d* which abuts on the drive unit 6. The whole rotary cam 5 is rotated by the drive unit 6. The drive unit 6 is disposed under the rotary cam 5, and has a horizontally movable slide block 6*b* provided at a drive-axial distal end of an air cylinder 6*a* and having a tapered portion 6*c* on the distal end side of the upper surface. The rotary cam 5 is rotated as the tapered portion 6*c* abuts on the slide plate 5*d* of the rotary cam 5 to push up the slide plate 5*d*.

The slide body 7 is disposed under the pad 3, has the hold part 7*a* provided at an upper portion on the bending part 5*a* side of the rotary cam 5 and constituting a part of a male die for workpiece forming, and is held to be slidable obliquely upward. As shown in FIG. 1, an end face of the hold part 7*a* of the slide body 7 and an end face of the bending part 5*a* of the rotary cam 5 slidably abut on each other, and rotate together with the rotary cam 5 about the rotational center 5*c*. When the top surface of the hold part 7*a* slides obliquely upward and is aligned with the top surface of the bending part 5*a*, a projecting work surface (male die) for forming a workpiece 12 is formed. A recessed work surface (female die) corresponding to the former work surface is formed at the bottom side of the pad 3.

The slide drive unit 8 includes a cam slide 9 having, on an upper side, a cam surface 9*a* on which the slide body 7 slides upward, and having a lower end supported at an end portion of the rotary cam 5 so as to be movable laterally, a coil spring 10 serving as an urging section to urge the cam slide 9 in a direction away from the rotational center of the rotary cam 5, and an upper die driver 11 having, at a lower end portion of a side face thereof, a cam surface 11*a* which abuts on a cam surface 9*b* formed at an upper end portion of a side face of the cam slide 9 to forcibly move the cam slide 9 laterally, and fixed to the upper die 2.

In the initial position state where the upper die 2 of the negative-angle press-working die 1 with the foregoing structure is at the top dead center and the pad 3, the aerial cam 4 and the upper die driver 11 are all at the top dead center, the workpiece 12 such as a body side outer panel, is placed in the die, and the drive unit 6 is driven first.

As the drive unit 6 is driven, a cylinder rod extends out and the slide block 6*b* at the distal end slides forward on a plate 13. Then, the tapered portion 6*c* of the slide block 6*b* abuts on the slide plate 5*d* and pushes up the slide plate 5*d*, so that the rotary cam 5 rotates about the rotational center 5*c* clockwise. When the slide block 6*b* further moves forward and the slide plate 5*d* comes to the horizontal upper surface of the slide block 6*b*, the rotation of the rotary cam 5 stops.

The slide body 7 and cam slide 9, supported on the rotary cam 5, rotate together according to the rotation of the rotary cam 5, so that a side end face 9*c* of the cam slide 9 becomes parallel to a vertical side face 11*b* of the upper die driver 11.

Next, when the upper die 2 moves down toward the lower die 14, first, the cam surface 11*a* of the upper die driver 11 abuts on the cam surface 9*b* of the cam slide 9, moving the cam slide 9 rightward against the urging force of the coil spring 10. The movement of the cam slide 9 causes the lower end face of the slide body 7 to slide on the cam surface 9*a*, pushing the slide body 7 obliquely upward, so that the top surface of the hold part 7*a* is level with the top surface of the bending part 5*a*, both of which abut on the bottom surface of the workpiece 12.

Then, the pad 3 supported by a spring 15 (see FIG. 1) or the like presses the workpiece 12 from above. As the upper die 2 further moves downward, the vertical side face 11*b* of the upper die driver 11 comes in slide contact with the side end face 9*c* of the cam slide 9, thus keeping the cam slide 9 moved rightward. Meanwhile, the cam surface 4*a* of the aerial cam 4 abuts on the cam surface 5*b* of the rotary cam 5, and moves on the cam surface 5*b* toward the bending part 5*a* located obliquely leftward as the upper die 2 further moves downward. It is to be noted that the vertical side face 11*b* of the upper die driver 11 and the side end face 9*c* of the cam slide 9 are formed and arranged so as to provide timing in the up and down direction.

Figure 2:
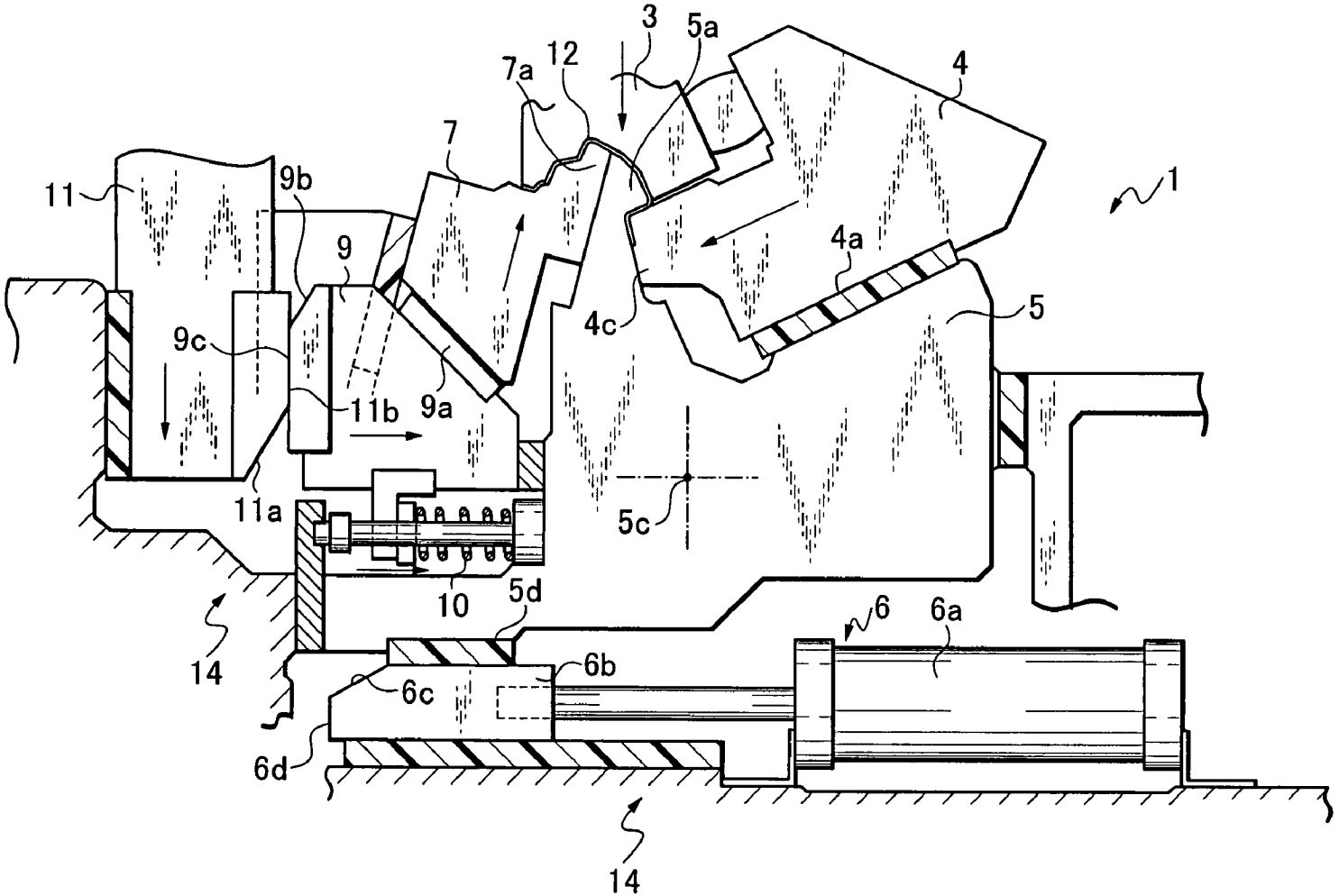
FIG. 2 is a longitudinal cross-sectional view showing the movement of the negative-angle press-working die in bending a workpiece.

The bending blade 4*c* of the aerial cam 4 presses the workpiece 12 held between the bending blade 4*c* and the bending part 5*a* of the rotary cam 5 to effect deep bending (see FIG. 2).

Figure 3:
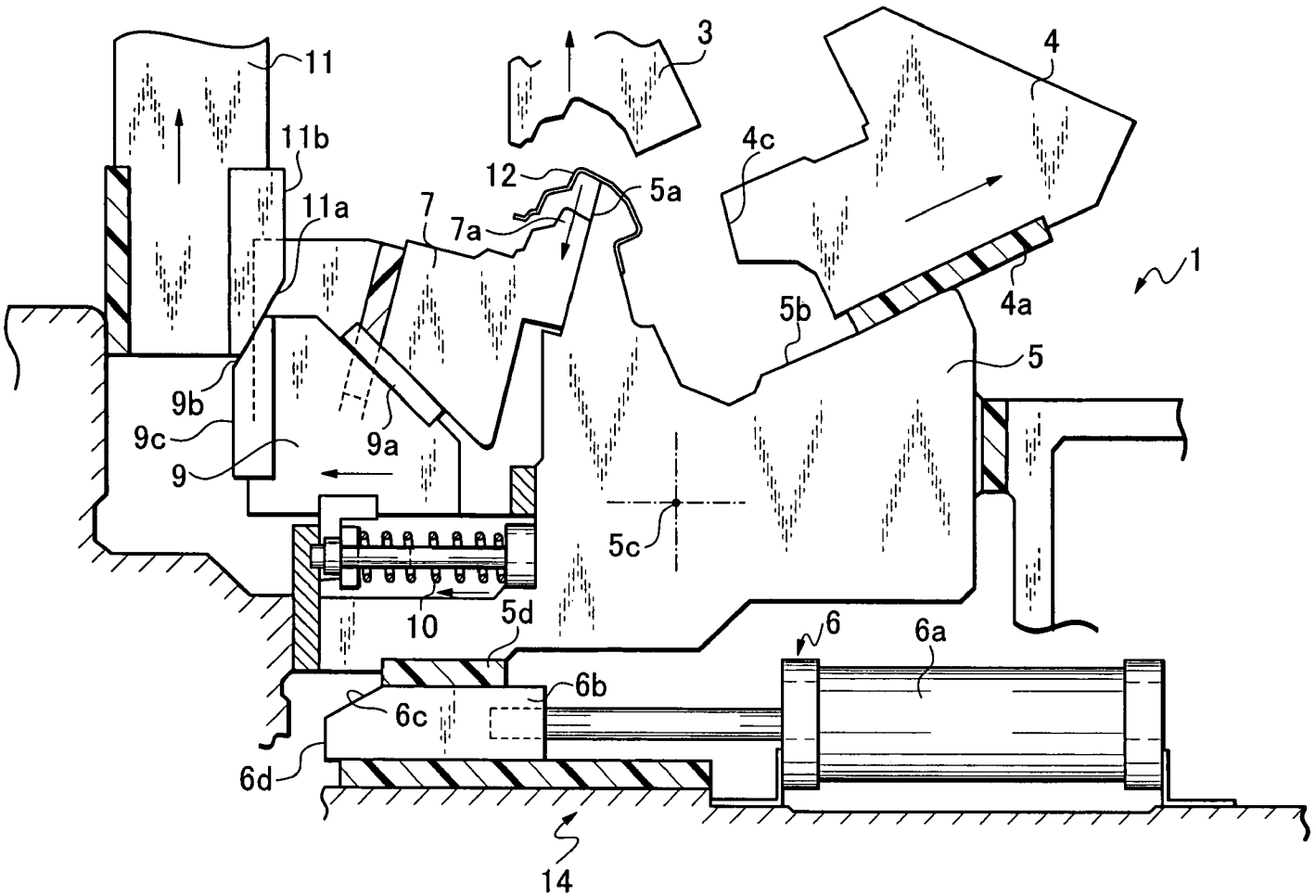
FIG. 3 is a longitudinal cross-sectional view showing the return movement of the negative-angle press-working die after workpiece bending.

Thereafter, when the upper die 2 moves upward, as shown in FIG. 3, the aerial cam 4 and the upper die driver 11 move at the same time, so that the bending blade 4*c* moves away from the bending part 5*a*. When the position of contact between the cam slide 9 and the upper die driver 11 is shifted from between the vertical side face 11*b* and the side end face 9*c* to between the cam surface 11*a* and the cam surface 9*b*, the cam slide 9 is urged by the coil spring 10 to move leftward. This causes the slide body 7 to slide down on the cam surface 9*a* obliquely. Accordingly, the hold part 7*a* moves away from the bottom surface of the workpiece 12. The pad 3 is pulled upward via the spring 15 or the like.

Figure 4:
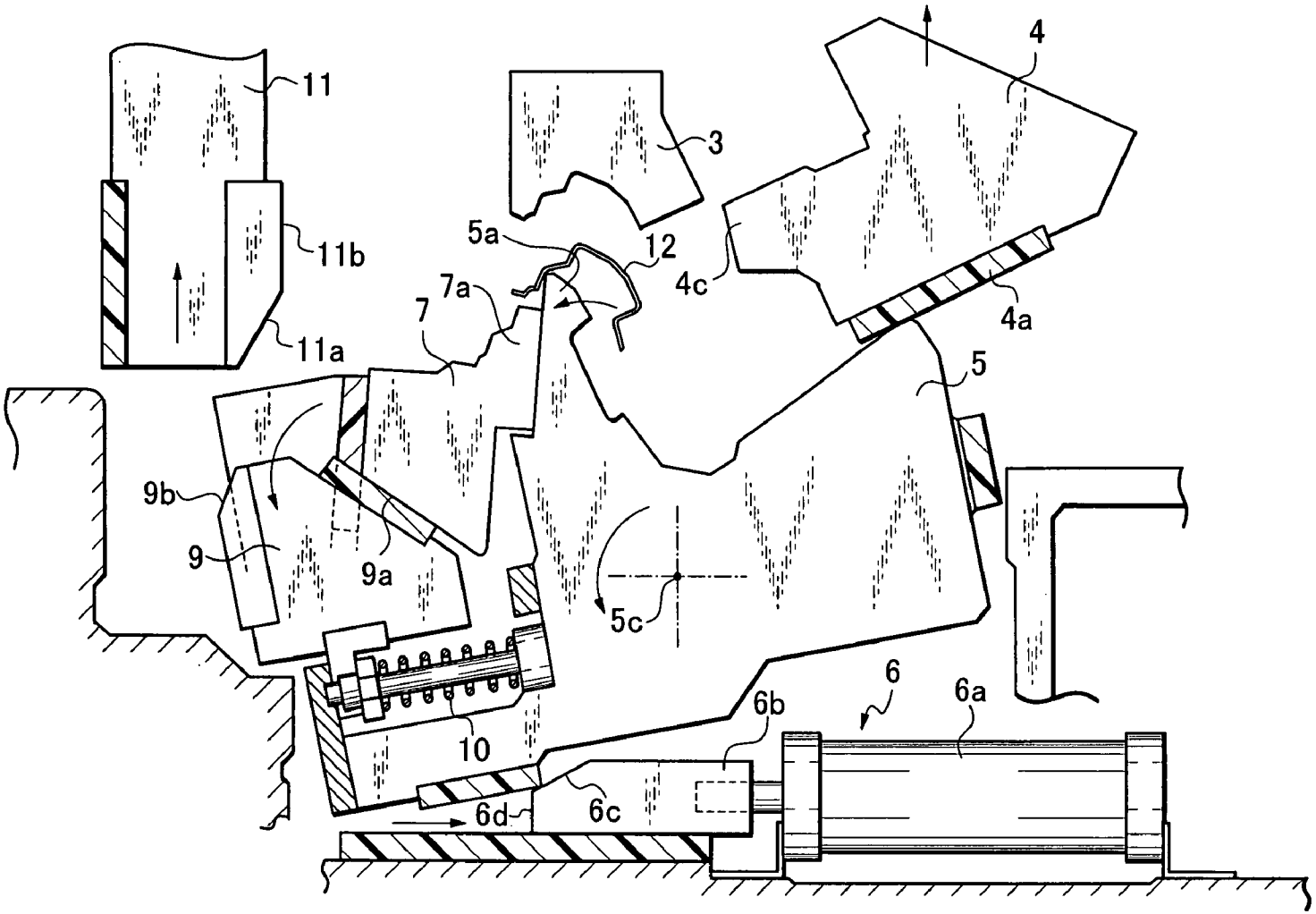
FIG. 4 is a longitudinal cross-sectional view showing the initial state of the negative-angle press-working die after workpiece bending is completed.

Next, the upper die 2 further moves upward, so that the upper die driver 11 and the aerial cam 4 move upward. Then the slide block 6*b* is moved rightward by the air cylinder 6*a* of the drive unit 6. Accordingly, the rotary cam 5 rotates about the rotational center 5*c* counterclockwise, causing the bending part 5*a* to move away from inside the workpiece 12. As a result, sufficient space for panel removal is secured under the workpiece 12, as shown in FIG. 4. Therefore, such negative angle forming with deep bending is possible.

When the workpiece 12 after bending is removed from the die 1, the die 1 returns to the initial state shown in FIG. 1. In the negative-angle press-working die 1 according to the present invention, as apparent from the above, the slide body 7 which has the hold part 7*a* constituting a part of a male die for workpiece forming, and slides in the up and down direction is provided at the rotary cam 5, so that when the workpiece is subjected to bending, the hold part 7*a* is separated from the workpiece 12 first and the bending part 5*a* is rotated into the space formed by the separation of the hold part 7*a* so as to be separated from the workpiece 12.

Figure 5:
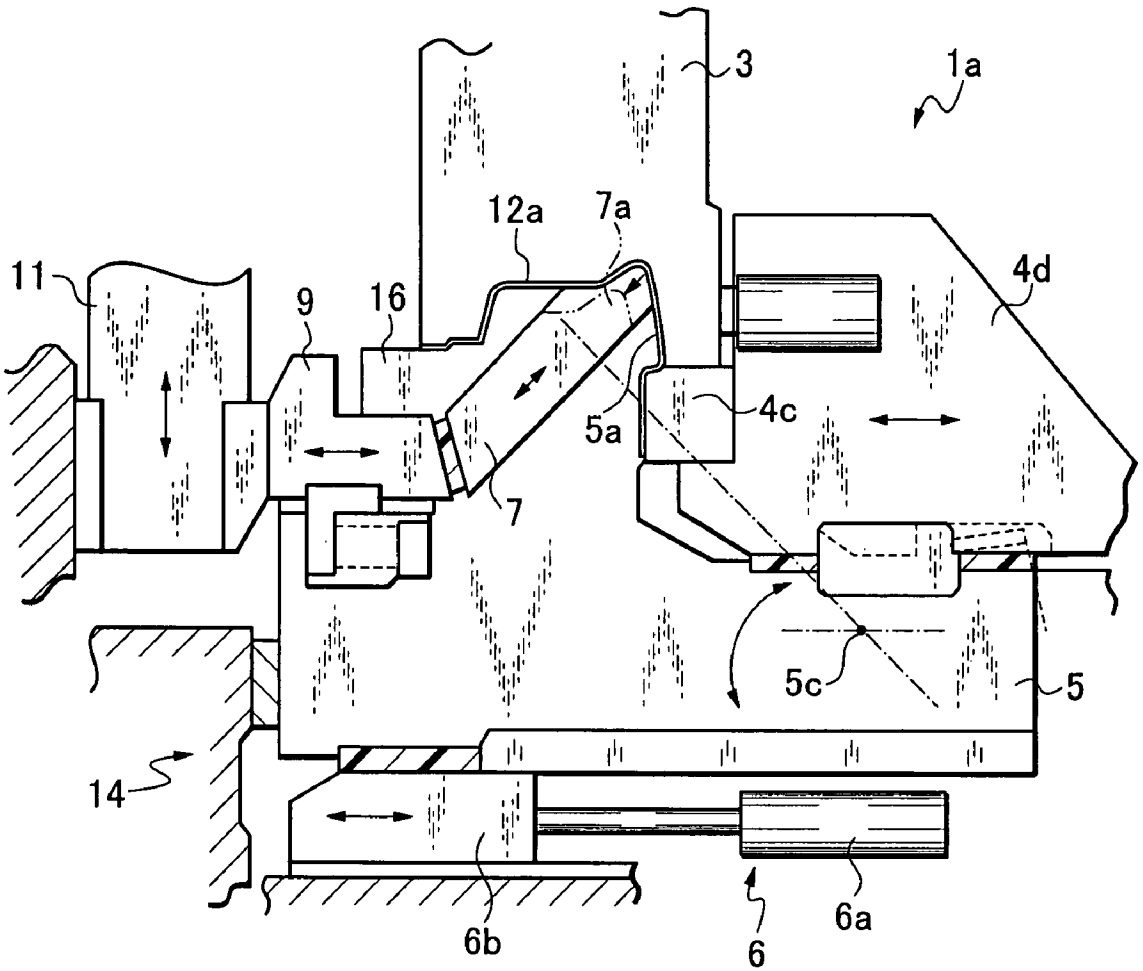
FIG. 5 is a longitudinal cross-sectional view showing the schematic structure of a negative-angle press-working die according to another embodiment of the present invention.
Figure 6:
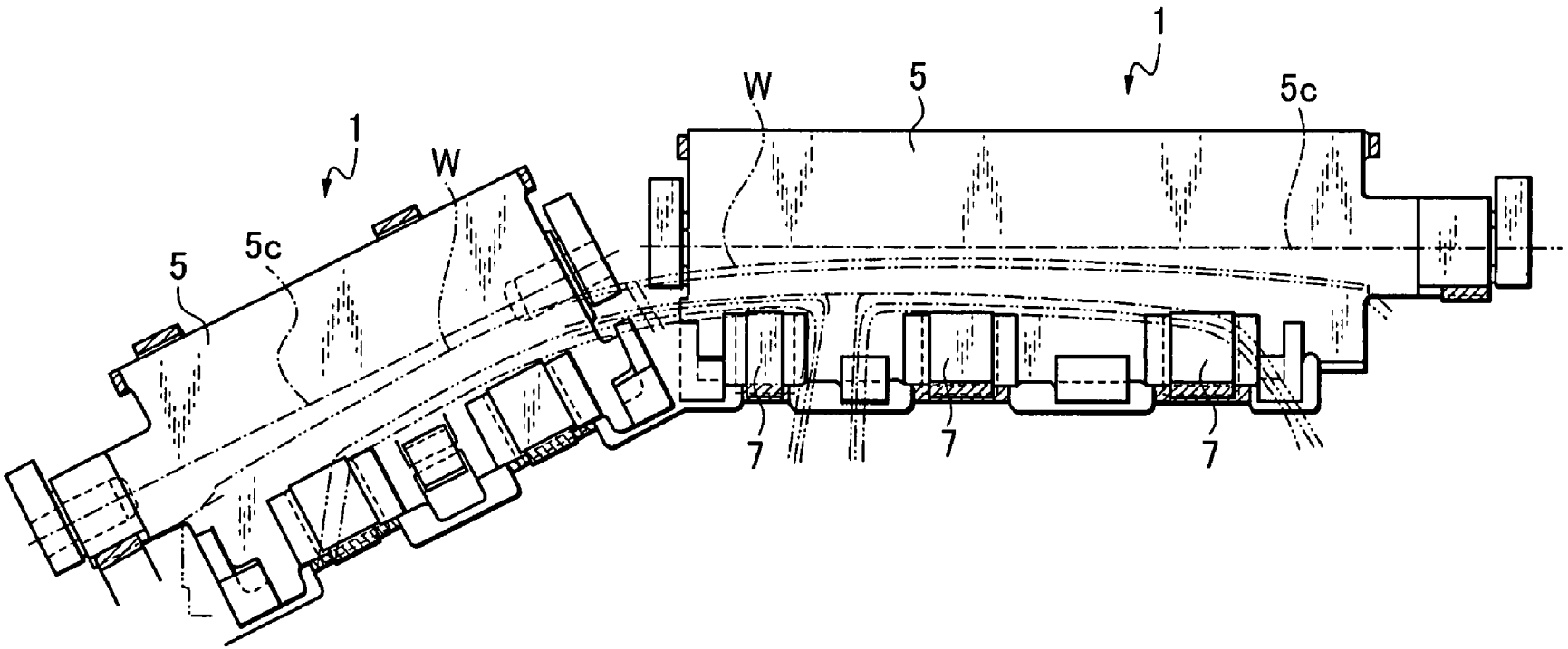
FIG. 6 is a plan view showing an example of usage of the negative-angle press-working die according to the present invention.
Figure 7:
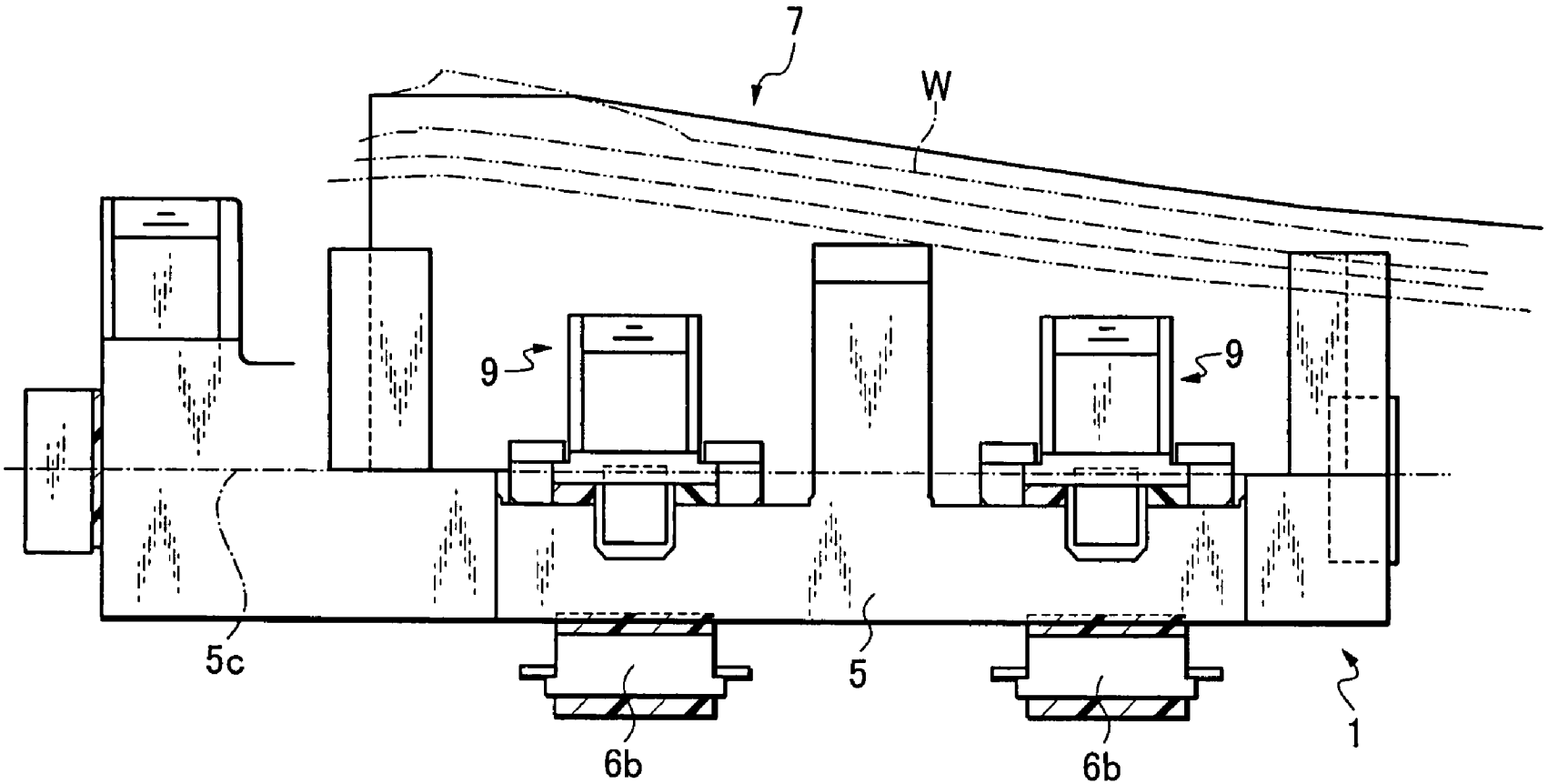
FIG. 7 is a front view showing a state where the axis of the rotational center of the negative-angle press-working die is set horizontal to a workpiece having a curved shape.
Figure 8A:
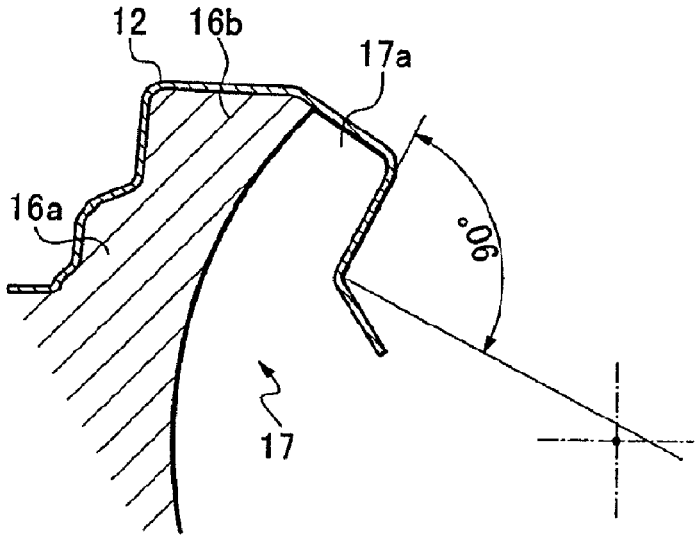
Fig. 8A PRIOR ART
FIG. 8A is a cross-sectional view of essential portions showing a conventional press-working die in use, and FIG.
Figure 8B:
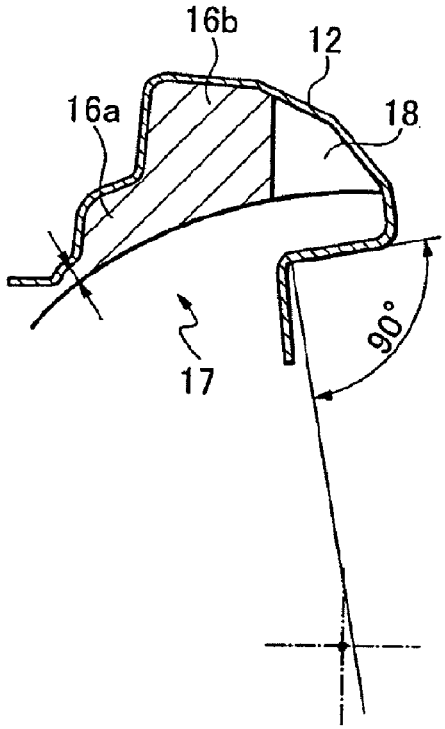
Fig. 8B PRIOR ART
Figure 9:
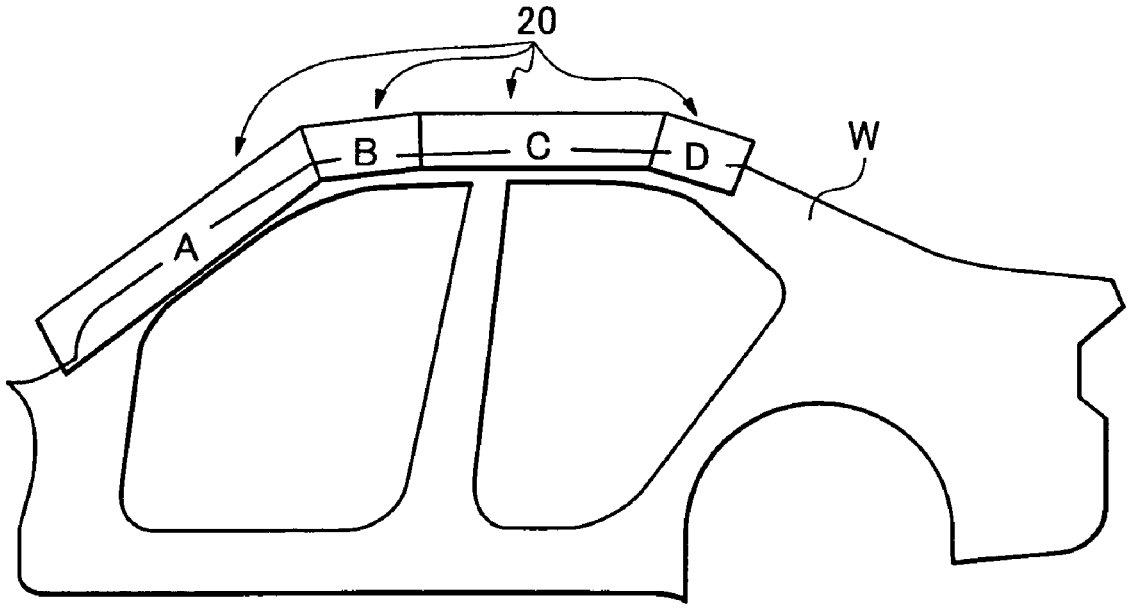
Fig. 9 PRIOR ART
FIG. 9 is a front view showing an example of usage where a conventional press-working die is separated into four sections.

FIG. 5 shows another embodiment of the present invention. A negative-angle press-working die 1*a* includes a slide body 7 having a fixed punch 16 and a hold part 7*a* and being slidable obliquely upward and downward with respect to a workpiece 12*a*, a rotary cam 5 having a bending part 5*a*, and a slide cam 4*d* supported at a lower die and laterally slidable on the rotary cam 5, with a rotational center 5*c* set at a proper position. This structure can cause the rotary cam 5 to rotate counterclockwise to move the bending part 5*a* away from the bottom surface of the workpiece 12*a*, thus securing a panel removal clearance, as in the above-described embodiment.

What is claimed is:

1. A negative-angle press-working die comprising:

an elevatable pad fixed to an upper die;

a slide cam supported on the upper die or a lower die, having a bending blade formed at one end portion, having cam surfaces on both upper and lower sides, and supported so as to laterally slide along both of the cam surfaces;

a rotary cam having, at one end thereof, a bending part that forms a negative-angle portion on a workpiece, having a cam surface abutting on one of the cam surfaces of the slide cam, and being rotatable about a rotational center;

a slide body disposed under the pad, having a hold part provided at an upper portion on a bending part side of the rotary cam and constituting a part of a male die for workpiece forming, elevatably held, and being rotatable together with the rotary cam;

a drive unit that rotates the rotary cam at a workpiece working position; and a slide drive unit that slides the slide body in an up and down direction;

wherein the slide drive unit includes a cam slide having, on an upper side, a cam surface on which the slide body is slidable, and having a lower end supported at an end portion of the rotary cam so as to be movable laterally, an urging section that urges the cam slide in a direction away from the rotational center of the rotary cam, and an upper die driver having, at a lower end portion of a side face thereof, a cam surface which abuts on a cam surface formed at an upper end portion of a side face of the cam slide to forcibly move the cam slide laterally, and fixed to the upper die.

2. The negative-angle press-working die according to claim 1, wherein the drive unit is disposed under the rotary cam, and has a horizontally movable slide block provided at a drive-axial distal end of an air cylinder and having a tapered portion at an upper surface on a distal end side, and the rotary cam is rotated as the tapered portion abuts on a lower portion of the rotary cam to push up the lower portion.

* * * * *